US005584350A

United States Patent [19]

Schnitker et al.

[11] Patent Number: 5,584,350

[45] Date of Patent: Dec. 17, 1996

[54] WELLBORE SIDETRACKING METHODS

[75] Inventors: Mark W. Schnitker, Friendswood; Shane P. Hart; Steve R. Delgado, both of Houston, all of Tex.

[73] Assignee: Weatherford U.S., Inc., Houston, Tex.

[21] Appl. No.: 532,180

[22] Filed: Sep. 22, 1995

[51] Int. Cl.[6] ..... E21B 7/06

[52] U.S. Cl. ..... 175/61; 166/117.6; 175/80; 175/81

[58] Field of Search ..... 166/117.6, 117.5, 166/382; 175/79, 80, 81, 82, 61

[56] References Cited

U.S. PATENT DOCUMENTS

| | | | |
|---|---|---|---|
| 1,570,518 | 1/1926 | Mitchell | 175/79 |
| 1,589,399 | 6/1926 | Kinzbach . | |
| 1,806,509 | 5/1931 | Straatman . | |
| 2,058,327 | 10/1936 | Lane | 255/1 |
| 2,100,684 | 11/1937 | Carroll | 255/1 |
| 2,132,061 | 10/1938 | Walker | 255/1 |
| 2,147,537 | 2/1939 | Lowrey | 166/298 |
| 2,297,029 | 9/1942 | Shepherd et al. | 255/1.6 |
| 2,331,293 | 10/1943 | Ballard | 255/1.6 |
| 2,509,144 | 5/1950 | Grable et al. | 255/1.6 |
| 2,699,920 | 1/1955 | Zublin | 255/1.6 |
| 2,766,010 | 10/1956 | Hester | 166/117.6 |
| 2,858,107 | 10/1958 | Colmerauer | 166/117.6 |
| 3,095,039 | 6/1963 | Kinzbach | 166/117.6 |
| 4,182,423 | 1/1980 | Ziebarth et al. | 175/61 |
| 4,415,205 | 11/1983 | Rehm et al. | 299/5 |
| 5,012,877 | 5/1991 | Winters et al. | 175/80 |
| 5,154,231 | 10/1992 | Bailey et al. | 166/298 |
| 5,287,921 | 2/1994 | Blount et al. | 166/117.6 |
| 5,318,132 | 6/1994 | Odorsio | 166/117.6 X |
| 5,335,737 | 8/1994 | Baugh | 175/61 |
| 5,445,222 | 8/1995 | Pritchard et al. | 116/298 |
| 5,462,120 | 10/1995 | Gondouin | 166/380 |
| 5,488,989 | 2/1996 | Leising et al. | 166/117.6 X |

OTHER PUBLICATIONS

"The Submudline Drivepipe Whipstock Patent #4,733,732," Frank's Casing Crew, prior to 1994.

"A Novel Approach To Initaiting Multi–Lateral Horizontal Wells," Konopczynski et al, SPE/1ADC, 1995.

"A–1 Section Mill," A–1 Bit & Tool Co., 1990.

"Catalog 1958–59" Kinzbach Tool Co., Inc., 1958, especially pp. 3–5.

"General Catalog 68–69," A–1 Bit & Tool Co., Inc., 1968, especially pp. 135,138, 139.

"1976–77 General Catalog," A–1 Bit & Tool Co., Inc., 1976, especially p. 116.

"The One To Call is A–1", A–1 Bit & Tool Co., Inc., pp. 121–128.

*Primary Examiner*—Hoang C. Dang

*Attorney, Agent, or Firm*—Guy McClung

[57] ABSTRACT

A wellbore sidetracking method has been invented which includes, in certain embodiments, milling out a casing section from a cased, cemented wellbore; placing a deflection device, e.g. a whipstock, so that, upon pivoting of the upper concave portion of the whipstock at least a top portion thereof extends up into and abuts casing above the milled out section and, in certain aspects, a portion of the whipstock also extends down into and abuts casing below the milled out section; introducing a mill into the wellbore to mill out a part of the casing above the milled out section which would interfere with the introduction of a drill bit; removing the mill; introducing a drilling system into the wellbore to be deflected into the milled out area; and drilling a new sidetracked bore with the drilling system from the milled out area. In one aspect a mill is provided which mills out the part of the casing above the milled out area without contacting the formation or with only minimal contact thereof.

9 Claims, 5 Drawing Sheets

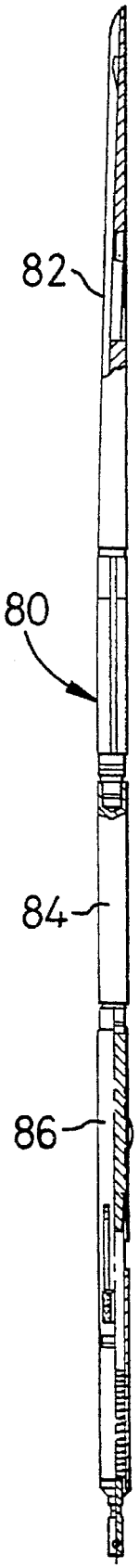
FIG. 3
FIG. 4A
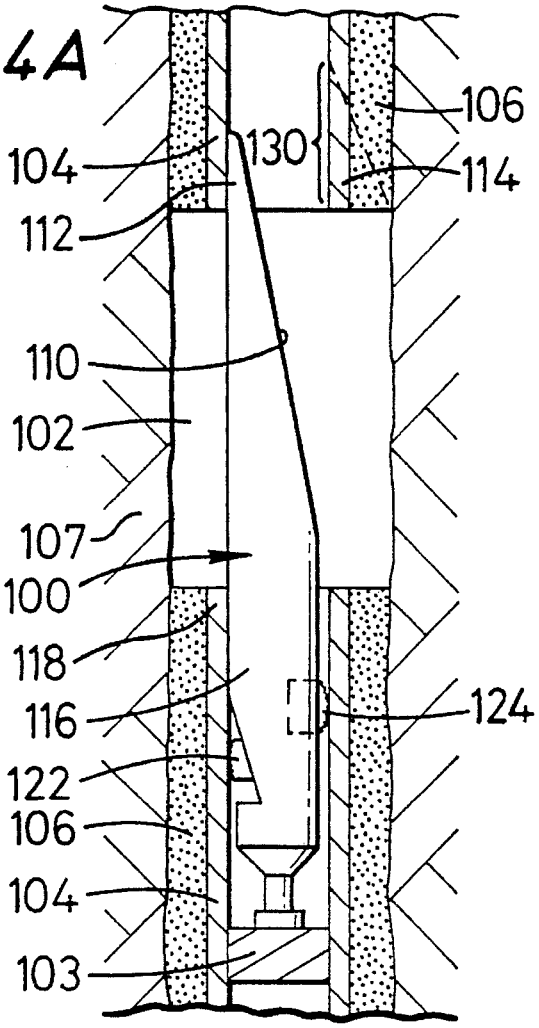
FIG. 4B
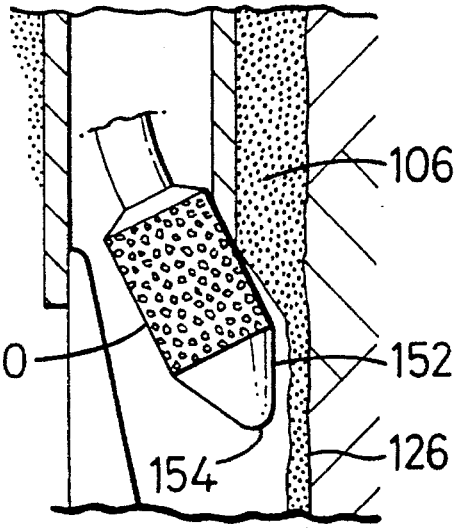

WELLBORE SIDETRACKING METHODS

BACKGROUND OF THE INVENTION

1. Field of the Invention

This invention is directed to wellbore sidetracking methods, wellbore milling methods, and apparatuses useful in such methods.

2. Description of Related Art

In a variety of typical milling operations a section of casing cemented in a cased wellbore is milled out and then a whipstock is positioned adjacent a portion of the milled out section with the top of the whipstock contacting the interior surface of the cement or wellbore which was exposed when the casing section was milled out. Further milling of the casing is done by milling systems which are biased against the casing by contacting a concave surface of the whipstock. A mill used with such a system typically mills a portion of the cement between the exterior surface of the casing and the interior surface of the wellbore and then a portion of the formation through which the wellbore extends as the mill moves further into and/or down the casing.

The present inventors have recognized a problem associated with milling in a wellbore in a hard, tough, abrasive earth formation (e.g., but not limited to the Embar formation). Rather than being deflected into such a formation by the concave of a whipstock, the formation itself may deflect the mill against the whipstock resulting in damage to the whipstock and ineffective or incomplete milling of casing.

In a variety of wellbore sidetracking operations a section of casing is milled out from a cased, cemented wellbore; a deflector, e.g. a whipstock is positioned adjacent the milled section; and then a drill bit is inserted into the wellbore to contact the whipstock to be deflected thereby, and then to drill another bore off from the milled section area. Often the portion of milled casing has an upper edge or stub which is contacted by the drill bit as it begins to drill away from the whipstock. Many drill bits will not cut casing, cut it poorly, and/or are damaged by contact with casing.

In a variety of prior art drilling methods (see, e.g. U.S. Pat. Nos. 3,095,039; 2,699,920; and 1,570,518) a whipstock is set in a wellbore with a bottom portion anchored in the wellbore or in a lower tubular in the wellbore and with a top portion resting against the wellbore. Such positioning of a whipstock creates a variety of problems. The whipstock may not be stable since the formation is not necessarily stable, a top of the whipstock may be unsupported or positioned over a void in the formation. The whipstock resting against the wellbore may not produce accurate positioning and therefore drilling may commence in an undesired direction. Also, when a whipstock abuts a formation there may be more open area in which a mill can "walk off" a concave.

SUMMARY OF THE PRESENT INVENTION

The present invention, in one embodiment, discloses a sidetracking method in which a section of casing is milled out from a cased wellbore so that an area of the wellbore (and/or annular cement) is exposed with an end or "stub" of the milled casing at the top of exposed area and another end or stub of the casing at the bottom of the exposed area. Then a deflection device (e.g. a whipstock with an upper concave surface) is positioned so that a top of the deflection device extends up into, contacts, and rests against the top stub. In one aspect the bottom of the whipstock rests in and/or against a portion of the exposed wellbore area. In another aspect the bottom of the whipstock is secured in the lower casing by any of the well-known anchoring apparatuses.

With a whipstock in place as described above drilling (on a conventional drill string or with coil tubing) may commence. In another aspect, prior to drilling, a mill is inserted into the wellbore and a portion of the top stub is milled out (preferably without milling any of the formation through which the wellbore extends or milling only a minimal part of the formation) to facilitate entry of a drill bit into the exposed area and to prevent damage to the drill bit.

In one embodiment of a mill according to the present invention, the mill has a milling portion with a top, a bottom, and a middle. The middle has a portion at an angle tapering inwardly and downwardly to a lower part of the mill. This middle portion is disposed, sized, and configured so that as the milling portion progresses through the casing and annular cement, tilting as it goes, the middle portion assumes a position nearly parallel or parallel to a longitudinal axis of the wellbore at that location and, preferably, parallel or nearly parallel to the interior wellbore surface, i.e. the formation, at that location. Thus, milling of casing by an upper portion of the mill can continue, but the middle portion (and no other portion) of the mill does not contact the formation or such contact is minimal, thereby inhibiting, reducing, or preventing damage to the mill (or to a bit) or to the whipstock by the formation, forcing the mill (or a bit) into the concave. The top milling portion is sized, disposed, and configured so that a desired amount of the top stub is milled off before the mill contacts the formation. The extent of the various milling portions and the angle of the middle mill portion with respect to a longitudinal axis of the mill body is determined by the dimensions of the casing, width of the annular cement, and amount of top stub to be removed. In one particular embodiment such a mill is about two feet in length from the top of the blades to the nose and has six helically fluted blades which extend from the top mill portion down to a tapered blunt bottom nose and the angle of the middle milling portion is about sixty-seven degrees.

A whipstock according to one embodiment of this invention has an upper concave member, an extension member secured (permanently or releasably) at its top to a lower end of the concave member, and a lower whipstock body secured at its top (permanently or releasably) to a lower end of the extension member. Such a lengthened whipstock may be placed completely across the gap created when a casing section is milled out with the concave extending up into and resting against the casing above the milled out section and the bottom of the whipstock into casing below the milled out section. This provides greater tolerance and room for error in whipstock positioning and inhibits or prevents damage to the upper casing. By using such a lengthened whipstock it is easier to insure that the fulcrum point of the whipstock at a pivot slip is within the lower casing, rather than in the wellbore adjacent the milled out area. With such a disposition of a whipstock, when a retrievable whipstock is used, it is much easier to correctly and accurately engage the whipstock by a retrieval device, e.g. a hook entering a slot in the concave. This also prevents the hook from engaging the stub end of the casing or from contacting and/or engaging exposed formation in the milled out area.

With systems and methods according to this invention the size of lateral bores is maximized and mills and bits up to the drift size of the casing can be used.

It is, therefore, an object of at least certain preferred embodiments of the present invention to provide:

New, useful, unique, efficient, nonobvious methods and apparatuses for wellbore sidetracking in which a bit or mill deflection device is positioned to bridge a gap in casing with at least a top end of the deflection device contacting casing above the gap and, in certain aspects, also with a bottom end of the deflection device contacting casing below the gap;

Such methods in which the deflection device is a whipstock with an upper concave member and lower anchor apparatus for securing the bottom of the whipstock in the wellbore of the gap area or in the casing below the gap; in certain particular aspects the whipstock is a retrievable whipstock;

Such methods in which a mill is used to mill off a part of the upper casing to facilitate entry of a drill bit through the gap for drilling a side bore off from a main wellbore;

Such methods in which the mill has an angled surface which avoids or contacts only minimally the formation through which the wellbore extends;

Such methods in which the drill bit is directed and proceeds so that it does not contact and damage lower portions of the deflection device; e.g. when a whipstock is employed only the concave is contacted by the bit and, in certain aspects, the whipstock is sufficiently lengthened so that the bit does not contact lower portions of the whipstock body, setting slips, or lower casing stub etc;

Such methods which permit effective drilling of a side-tracked bore at a relatively abrupt angle to the axis of a main bore, e.g. an angle of one degree or more, and in one aspect up to thirty degrees;

Such methods in which effective casing stub milling can be accomplished in hard, tough, or abrasive formations; and Apparatuses useful in such methods.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 3 is a side view partially in cross-section, of a whipstock according to the present invention.

FIG. 4A is a side view in cross-section of a whipstock emplaced across a milled-out casing section in a wellbore according to the present invention. FIG. 4B shows milling in the wellbore of FIG. 4A according to the present invention.

DESCRIPTION OF EMBODIMENTS PREFERRED AT THE TIME OF FILING FOR THIS PATENT

Figure 1A:
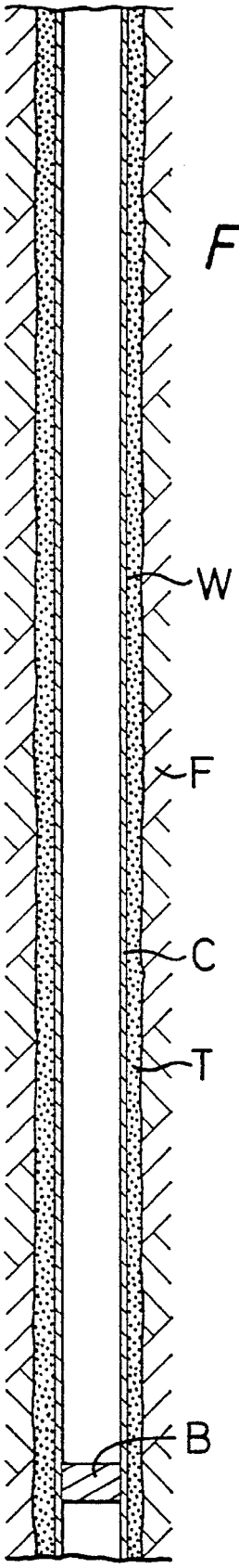
FIG. 1A–1F are side views of a method according to the present invention.

Referring now to FIG. 1, FIGS. 1A–F illustrate a method and certain apparatuses according to the present invention. FIG. 1A shows a wellbore W through a formation F cased with casing C cemented in place by cement T with a bridge plug B set in the casing C.

Figure 1B:
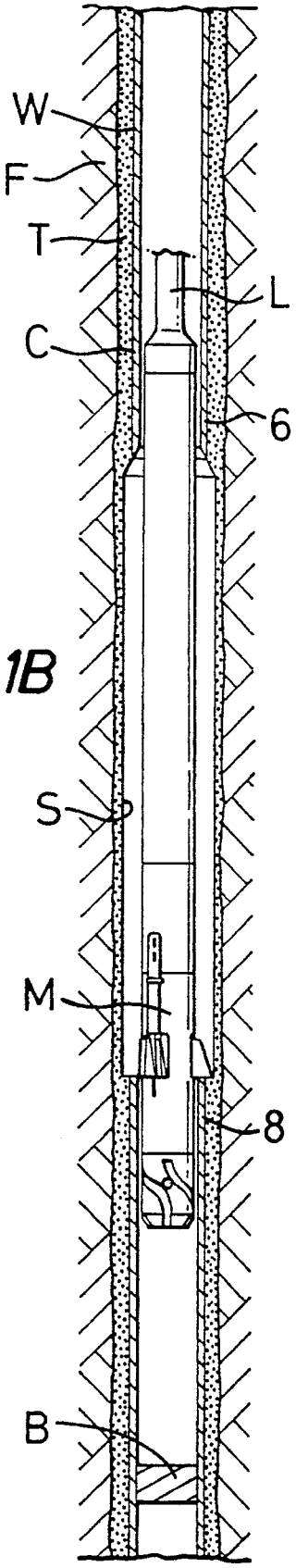

FIG. 1B shows a typical section mill M on a drill string L (shown partially, but extends up to surface equipment) which has milled out a section S from the casing C. This milling has also resulted in the milling of some of the cement T adjacent the section S. A top stub 6 and a bottom stub 8 of the casing remain.

Figure 1C:
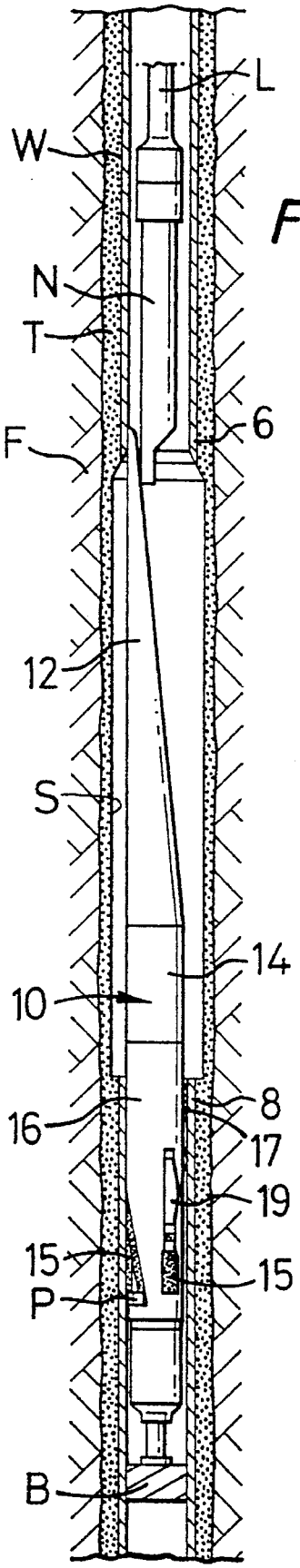

FIG. 1C shows a whipstock 10 according to the present invention with a concave 12 releasably secured to a body extension 14 which is itself releasably secured to a lower body member 16. A setting tool N is releasably secured (e.g. by a shear pin, not shown) to the concave 12. Alternatively a starting mill releasably secured to the concave by a shear pin or shear bolt may be used instead of the setting tool. Anchor apparatus P anchors the whipstock 10 in place on the bridge plug B and in the casing C. In other aspects instead of a bridge plug a packer or other "false bottom" device is used, or the whipstock is set on the bottom of the wellbore. Any suitable anchor apparatus (including well-known apparatuses not shown) may be used. The anchor apparatus P includes slips 15 and a pivot slip 17 which provides a fulcrum point about which the whipstock pivots. As shown in FIG. 1C the anchor apparatus is disposed on a part of the lower body 16 in the casing C beneath the section S. It is within the scope of this invention to anchor the whipstock 10 (or other deflection device used instead of the whipstock 10) within the section S; and, in certain embodiments, to anchor it on the top of the bottom stub and to use the bottom stub as a "trigger" to actuate setting or anchoring devices. Alternatively, anchoring both within the section S and within the casing C is within the scope of this invention. Stabilizers 19 (one shown) protect the slips while the whipstock is run into the wellbore.

The whipstock 10 is sized and disposed so that a top end of the concave 12 abuts the top stub 6 of the casing C. The lower body 16 abuts the bottom stub 8. It is within the scope of this invention for the concave to be of sufficient length to abut both stubs. In the embodiment shown in FIG. 1C the body extension 14 is of sufficient length that the concave 12 does not contact the bottom stub 8. Also, with the body extension of such a length a mill or drill bit is deflected sufficiently that it preferably will not contact the bottom stub 8 or parts of the whipstock within the bottom stub 8 (or will contact them only incidentally). As shown the whipstock 10 bridges the sections S from the top stub 6 to the bottom stub 8. In certain embodiments the section S is four to five feet long (up to fifty feet) and the whipstock is long enough to bridge the milled out section.

Figure 1D:
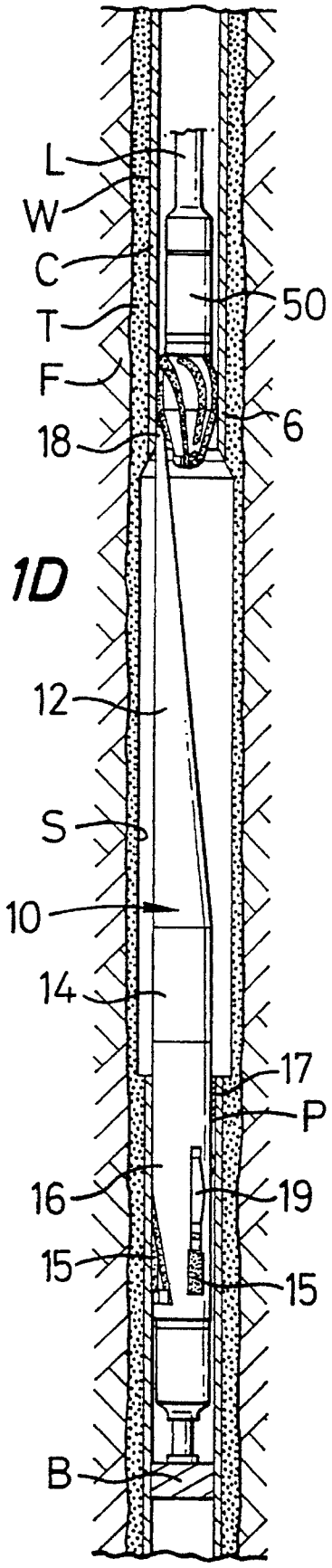

FIG. 1D shows the setting tool N removed and a mill 50 according to the present invention on a drill string L (or a coil tubing drilling system may be used) which has been inserted into the casing C and has contacted a top 18 of the concave 12 at which point milling of the top stub 6 has commenced.

Figure 1E:
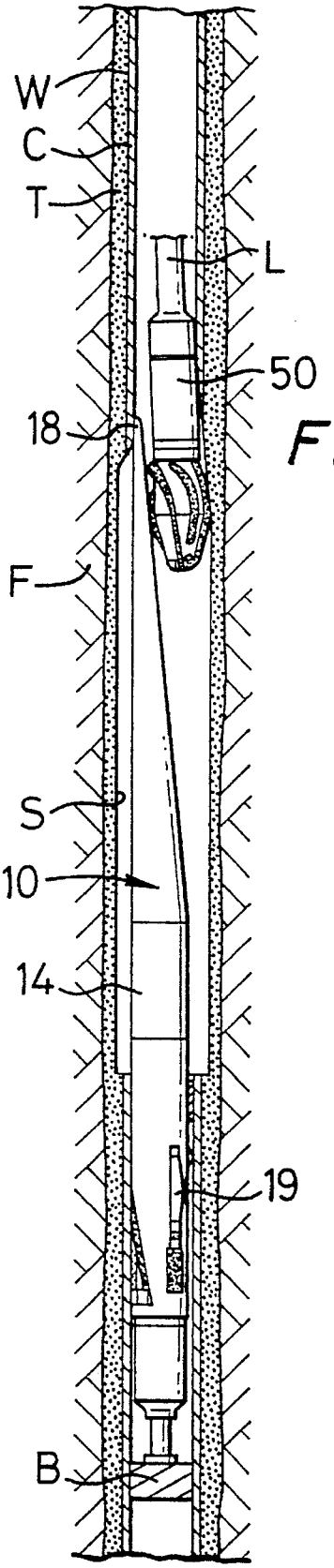

FIG. 1E shows the mill 50 as it has milled down past the end of the top stub 6 to contact the cement T (and, possibly, mill some of the cement T).

Figure 1F:
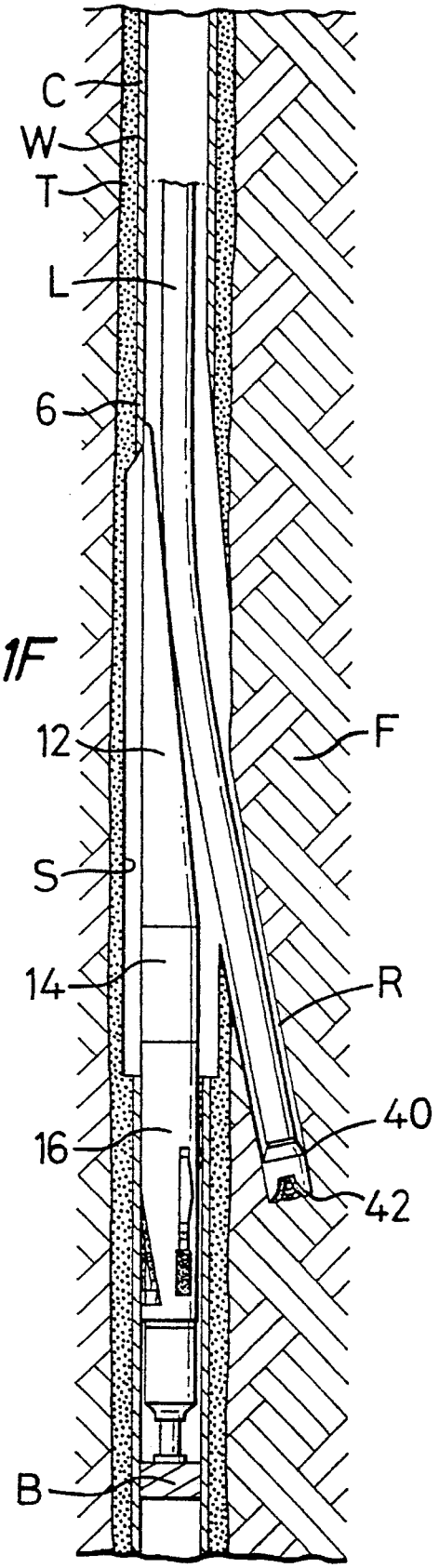

FIG. 1F shows that the mill 50 has been removed and a drill system 40 on the drill string L has been introduced into the casing C, has been deflected toward the section S by the concave 12, and has drilled a new bore R into the formation F. A drill bit 42 of the drill system 40 did not contact the top stub 6 in the drilling of the bore R. Also, the bit 42 has been deflected in such a way that it has not contacted the bottom stub 8 or the lower portion of the whipstock 10.

Figure 2A:
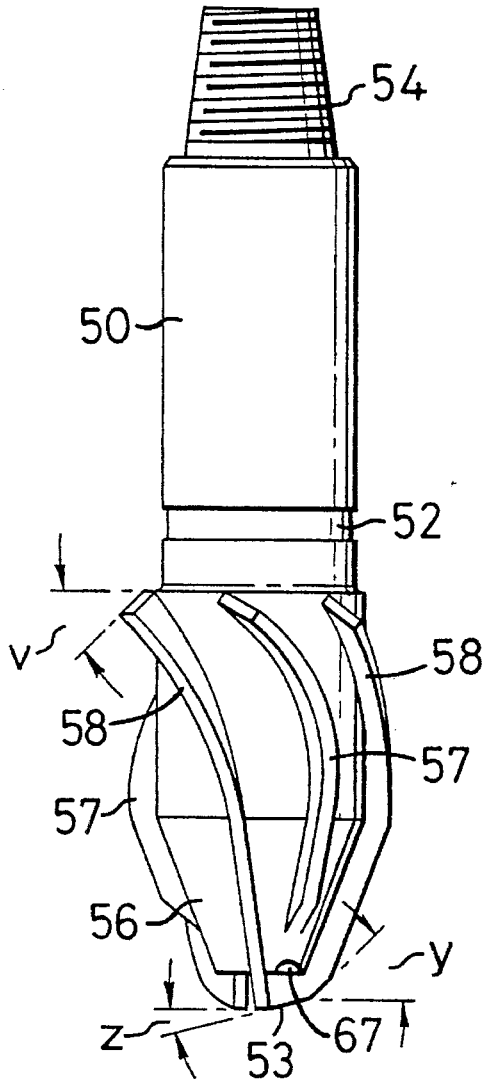
FIG. 2A is a side view of a mill according to the present invention.
Figure 2B:
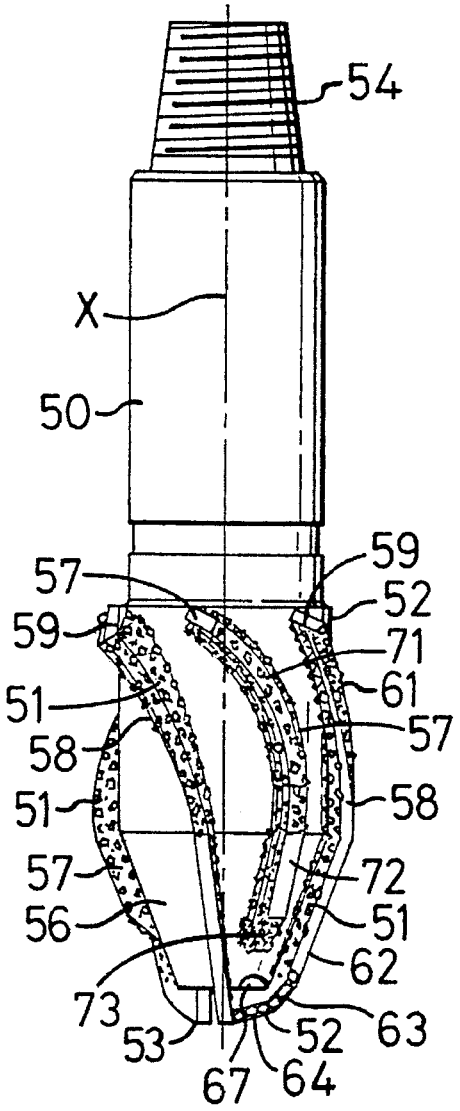
FIG. 2B is a side view of the mill of FIG. 2A.
Figure 2C:
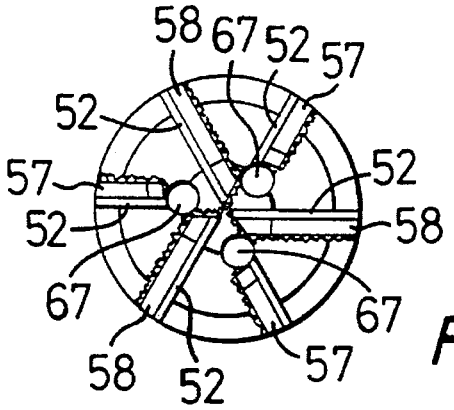
FIG. 2C is a bottom view of the mill of FIG. 2A.

FIGS. 2A–2C show various views of the mill 50. The mill 50 has a body 52 with a bottom nose 53, a top threaded end 54 and a bottom mill end 56. The mill end 56 has six blades, three blades 57 and three blades 58 extending outwardly and downwardly therefrom. As shown in FIGS. 2B and 2C, each blade may be dressed with tungsten carbide material 51 and/or milling inserts 52. It is within the scope of this invention for the blades to be dressed with materials and inserts according to any of the ways and patterns well-known in the art. It is also within the scope of this invention to use the inserts and other teachings of the U.S. Application entitled "Wellbore Milling Tools & Inserts" naming Christopher P. Hutchinson as inventor filed on even date herewith, Ser. No. 08/532,474 and co-owned with this application. It is within the scope of this invention to use any known section mill for the step shown in FIG. 1D. It is also within the scope of this invention to use the mill disclosed in the U.S. Application entitled "Section Milling" naming Christopher P. Hutchinson as inventor filed on even date herewith, Ser. No. 08/532,473 and co-owned with this application. Both applications cited above are incorporated fully herein for all purposes.

Each blade 58 extends from a blade top 59 to the bottom nose 53 of the mill 50. Each blade 58 has four milling surfaces 61, 62, 63, and 64. These milling surfaces are sized, configured, and disposed so that the mill 50 avoids or minimizes contact with the formation F, yet adequately mills away the bottom stub 6. The milling surface 62 is at an angle of about 23° to a central longitudinal axis X of the mill 50. The milling surface 63 is at an angle y to the horizontal. The angle y for the mill 50 as shown is about 45°. The milling surface 64 is at an angle of about 15° to the horizontal. The tops 59 of the blades 58 are at an angle of about 45° to the horizontal.

Each blade 57 has three milling surfaces 71, 72, and 73. The milling surfaces 71 on the blades 57 correspond to the milling surfaces 61 on the blades 58. The milling surfaces 72 correspond to the milling surfaces 62 on the blades 58. The milling surfaces 72 are also angled as are the milling surfaces 62 so that milling of the formation F is avoided (or reduced), (as are the milling surfaces 63 and 73). The mill end 56 is tapered to accommodate the various angled milling surfaces of the blades.

A plurality of fluid flow bores extend down through the mill 50 for the flow of circulating fluid through the mill to facilitate the evacuation of milled material. Fluid exits from these bores through exit ports 67 in the bottom nose 53 and then flows back up past the blades. It is within the scope of this invention to provide a mill without blades, but with angled milling surfaces which effect avoidance of formation contact or reduced formation contact.

FIG. 3 shows a whipstock 80 with an upper concave member 82; a body extension 84 connected to the upper concave member 84; and a lower whipstock portion 86 connected to the body extension 84. These connections may be permanent, e.g. welded, or releasable, e.g. shear-pinned or threaded. It is within the scope of this invention to use a retrievable whipstock as disclosed in U.S. Pat. No. 5,341,873 (co-owned with the present application).

FIG. 4A illustrates a retrievable whipstock 100 in a wellbore 102 in which is cemented casing 104 with cement 106. A formation 107 surrounds the wellbore 102. The whipstock rests on a bridge plug 103. The whipstock has a concave 110 which has a top 112 that rests against a top stub 114 of the casing 104. A lower portion of the whipstock body 116 rests against a bottom casing part 118. Slips 122 and 124 secure the whipstock 100 in the lower casing. It is desirable to mill off the part of the top stub 114 indicated by the bracket and numeral 130 to facilitate entry of a bit into the formation.

As shown in FIG. 4B the part 130 has been milled out by a mill 150 according to the present invention and the mill 150 has not milled past the cement 106. The mill 150 has an angled mill surface 152 which is substantially parallel to a formation surface 126 and a nose 154 of the mill 150 is blunt so that it does not contact the formation when the mill is in the position shown in FIG. 4B.

By employing a mill with a blunt nose and inwardly tapered sides and/or inwardly tapered blades (see FIGS. 2A and 4B) (tapered inward from top to bottom), contact with the formation is reduced or avoided completely (see FIGS. 1E and 4B). Preferred methods according to this invention are useful in producing sidetracked bores at relatively abrupt angles to the axis of a main wellbore, e.g. an angle of at most about thirty degrees and as small as about one degree. By using such a taper mill milling is effected to an extent equal to the total width of the mill and no undesirable unmilled casing portion or sliver is produced.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized.

What is claimed is:

1. A method for producing a sidetracked bore from a main wellbore, the main wellbore lined with a tubular member string comprised of a plurality of interconnected hollow tubular members, the method comprising milling out with milling apparatus a section of one of the hollow tubular members producing a milled out area with a first portion of the hollow tubular member above the milled out area and a second portion of the hollow tubular member below the milled out area, inserting a whipstock down through the first portion of the hollow tubular member so that a top end of the whipstock is disposed within a bottom end of the first portion of the hollow tubular member, removing the milling apparatus from the main wellbore, anchoring a lower end of the whipstock, introducing a tapered mill into the main wellbore, milling off pan of a lower end of the first portion of the hollow tubular member to facilitate entry of a drill bit into the milled out area, introducing a drilling system on a drilling system string into the main wellbore, the drilling system including a drill bit, moving the drill bit down in the main wellbore to contact the whipstock, deflecting with the whipstock the drill bit through the milled out area and to formation adjacent the milled out area, and drilling with the drill bit a bore into the formation away from the main wellbore.

2. The method of claim 1 further comprising the drilling system string comprising coil tubing reeled from a coil tubing unit through a coil tubing injector and a downhole motor for rotating the drill bit.

3. The method of claim 1 further comprising the drilling system string comprising a string of a plurality of interconnected pieces of drill pipe.

4. The method of claim 1 wherein the tapered mill is configured such that the part of the lower end of the first portion of the hollow tubular member is milled off without the tapered mill contacting an earth formation through which the wellbore extends.

5. The method of claim 1 wherein the whipstock is a retrievable whipstock and the method further comprising removing the retrievable whipstock from the main wellbore.

6. The method of claim 1 further comprising prior to inserting the whipstock into the main wellbore lengthening the whipstock so that it is long enough to abut both the first portion of the hollow tubular member above the milled out section and the second portion of the hollow tubular member below the milled out section.

7. The method of claim 6 wherein the whipstock is lengthened by interconnecting an extension member between an upper concave of the whipstock and a lower body portion of the whipstock.

8. The method of claim 1 further comprising anchoring a lower end of the whipstock in the second portion of the hollow tubular member.

9. The method of claim 1 wherein the hollow tubular member is a piece of casing.

* * * * *